United States Patent [19]

Carey

[11] 4,353,942

[45] Oct. 12, 1982

[54] COATING METHOD

[75] Inventor: Richard D. Carey, Waynesville, N.C.

[73] Assignee: Dayco Corporation, Dayton, Ohio

[21] Appl. No.: 207,585

[22] Filed: Nov. 17, 1980

[51] Int. Cl.[3] ..... B05D 1/18

[52] U.S. Cl. ..... 427/434.3; 427/430.1; 427/435; 427/443.2

[58] Field of Search ..... 118/410; 427/430.1, 427/434.3, 435, 443.2, 420; 228/37

[56] References Cited

U.S. PATENT DOCUMENTS

| | | | |
|---|---|---|---|
| 2,529,699 | 11/1950 | Lach | 118/410 |
| 3,435,802 | 4/1969 | Nail | 118/410 |
| 3,448,512 | 8/1968 | Saba | 228/37 |
| 3,526,536 | 9/1970 | Spengos et al. | 427/434.3 |
| 3,897,578 | 7/1975 | Kanda et al. | 118/410 |
| 4,004,045 | 1/1977 | Stelter | 427/430.1 |
| 4,060,649 | 11/1977 | Coleman | 427/79 |
| 4,117,798 | 10/1978 | Cornelius et al. | 118/423 |
| 4,127,692 | 11/1978 | Boynton | 228/37 |
| 4,238,039 | 12/1980 | Cooper et al. | 213/61 |

*Primary Examiner*—Michael R. Lusignan
*Assistant Examiner*—Richard Bueker
*Attorney, Agent, or Firm*—Joseph V. Tassone

[57] ABSTRACT

A coating method and apparatus are disclosed for providing a coating on irregular surface means of a workpiece and the method comprises the steps of providing a substantially nonmetallic liquid coating material, applying a liquid film of the liquid material on the irregular surface means, and drying the liquid film to solidify same and define the coating and wherein the applying step comprises the steps of producing a standing wave of the liquid coating material and moving the workpiece relative to the standing wave so that the liquid coating material engages the irregular surface means and defines the liquid film.

6 Claims, 6 Drawing Figures

COATING METHOD

BACKGROUND OF THE INVENTION

1. Field of the Invention

This invention relates to a method and apparatus for providing a coating on irregular surface means of a workpiece.

2. Prior Art Statement

It is known in the art to provide a coating, such as, of a nonmetallic liquid primer, on irregular surface means of a workpiece by spraying a liquid film of a liquid coating material on the irregular surface means and then drying the liquid film to solidify same and define the coating. It is also known to provide further successive coatings on such irregular surface means also by spraying and drying as mentioned. However, in applying a liquid coating material by spraying there are the usual problems of clogged spray nozzles and difficulty of controlling the thickness of the sprayed liquid film yet without allowing running of the sprayed liquid. Further, spray coating does not assure complete coverage of all portions of an irregular surface means.

It is also known to provide a coating of a liquid coating material on irregular surface means of a workpiece by dipping the entire workpiece in the liquid coating material. However, this technique usually results in excess coating material being used and often requires special drying equipment and additional drying time before the workpiece can be processed further.

It has also been proposed to make a wear member for use between a pair of relatively movable components of a railway vehicle and wherein the wear member is comprised of metal support means defined by a metal sheet having a planar surface and a grid-like metal structure fixed against the planar surface and with ultra high molecular weight polymeric material attached to the support means so that the grid-like metal structure serves as a means for attaching the polymeric material to the metal sheet of the support means while providing integral reinforcement of the polymeric material and as disclosed in U.S. patent application Ser. No. 27,340 now U.S. Pat. No. 4,238,039, issued Dec. 9, 1980. However, prior to bonding the polymeric material in position as disclosed in the above-mentioned patent application, it is common practice with certain types of grid-like structures to spray coat the irregular surface means defined by the planar surface of each metal sheet and its grid-like structure with a suitable primer followed by drying and then followed by spray coating over the primer with a suitable urethane base material again followed by drying before performing further process steps. However, these spray coating steps are all prone to the difficulties mentioned above.

It is also well known in the art to provide a method and apparatus for coating irregular surface means of a workpiece, such as a printed circuit board, or the like, which has various components and lead pins protruding therefrom utilizing so-called wave soldering apparatus and as disclosed in U.S. Pat. No. 4,208,002.

SUMMARY

It is a feature of this invention to provide an improved method for providing a coating on irregular surface means of a workpiece which comprises the steps of, providing a substantially nonmetallic liquid coating material, applying a liquid film of the liquid coating material on the irregular surface means, and then drying the liquid film to solidify same and define the coating.

For example, in accordance with one embodiment of this invention the applying step comprises the steps of producing a standing wave of the liquid coating material and moving the workpiece relative to the standing wave so that the liquid coating material engages the irregular surface means and defines the liquid film thereon.

Another feature of this invention is to provide a method of the character mentioned for coating such irregular surface means wherein the irregular surface means is a part of metal support means of a railway vehicle wear member and defined by a metal support sheet having a planar surface and a grid-like metal structure fixed against the planar surface.

Another feature of this invention is to provide an improved apparatus for providing a coating on irregular surface means of a workpiece including a workpiece in the form of a metal support means of a railway vehicle wear member of the character mentioned.

Therefore, it is an object of this invention to provide an improved method and apparatus for providing a coating on irregular surface means of a workpiece having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DETAILED DESCRIPTION

Figure 1:
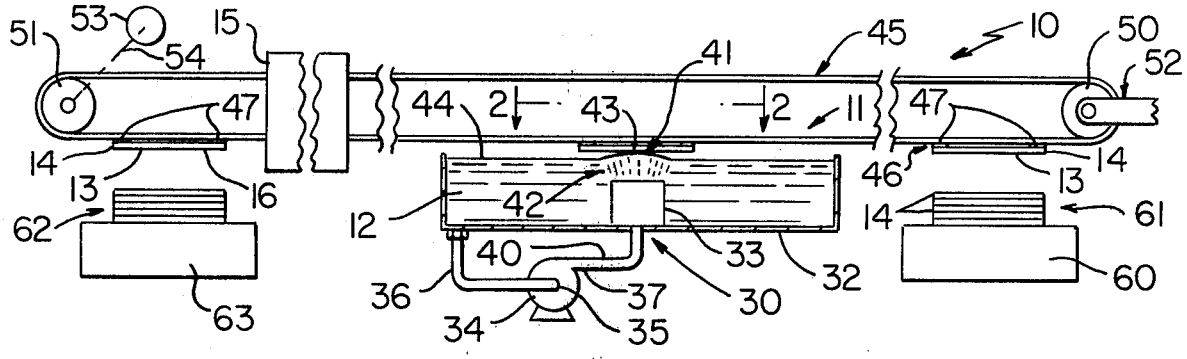
FIG. 1 is a side view with parts shown schematically and parts broken away illustrating one exemplary embodiment of the method and apparatus of this invention.
Figure 2:
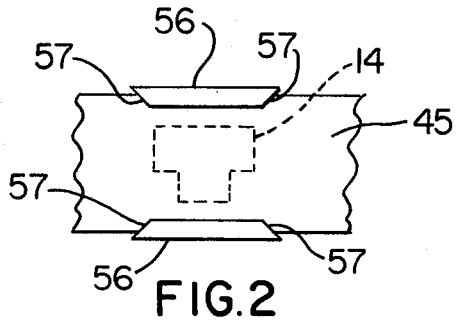
FIG. 2 is a fragmentary view taken essentially on the line 2—2 of FIG. 1.
Figure 5:
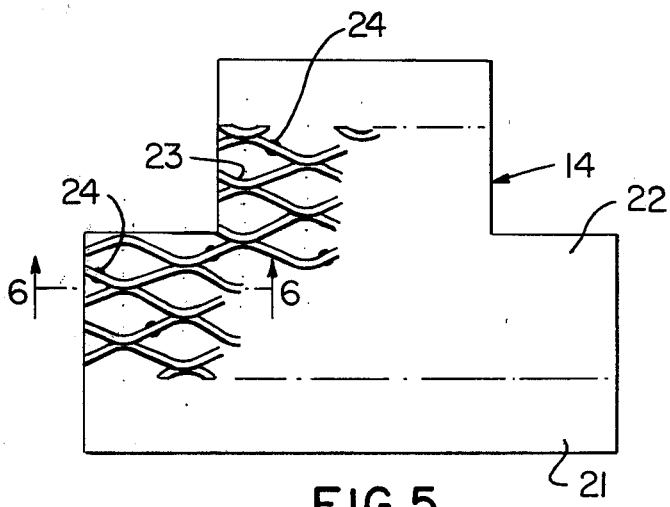
FIG. 5 is a plan view of the metal support means of the wear member of FIG. 4 showing the configuration thereof prior to coating same utilizing the method and apparatus of this invention and prior to forming the polymeric material in position and final forming edge portions of the support means.
Figure 6:
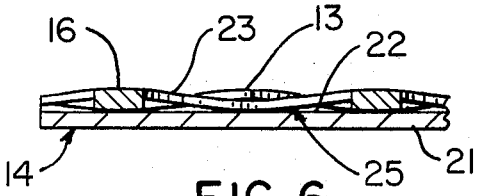
FIG. 6 is a fragmentary cross-sectional view showing a portion of the metal support means after coating thereof.

Reference is now made to FIGS. 1–2 of the drawings which illustrate one exemplary embodiment of the method and apparatus of this invention which are designated generally by the reference numeral 10. The apparatus 10 comprises means 11 for applying a liquid film of a substantially nonmetallic liquid coating material 12 on irregular surface means 13 of a workpiece 14 (FIG. 5) and means 15 for drying the liquid film to solidify same and define a coating 16 as shown in FIG. 6. The drying means may be any suitable means known in the art (including drying in ambient air) and in this example is shown as an oven or a heat tunnel 15. The heat tunnel 15 is provided with suitable temperature control means and may include means for circulating air.

Figure 4:
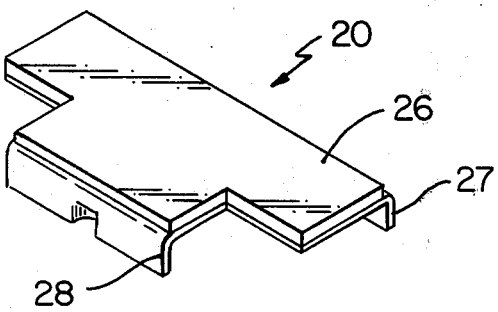
FIG. 4 is an isometric view of a completed railway vehicle wear member having metal support means defined by a metal sheet and a grid-like metal structure fixed against a planar surface of the metal sheet to define irregular surface means and having an ultra high molecular weight polymeric material bonded against the irregular surface means.

The workpiece 14 may be any workpiece which has what will be referred to as irregular surface means 13 which is to be coated; however, in this example of the invention such workpiece is a metal support means 14 for a railway vehicle wear member which is shown in FIG. 4 and designated by the reference numeral 20. The reference numeral 14 will be used herein to refer to the workpiece or support means 14 both before forming thereof and after final forming to the configuration shown in FIG. 4.

The support means 14 comprises a metal sheet 21 (FIG. 5) having a planar surface 22 and a grid-like structure 23. The structure 23 of this example is an expanded metal structure 23 which is fixed against the planar surface 22 by any suitable means, such as by suitable welds 24. The irregular surface means 13 of support means 14 is defined by the planar surface 22 and the expanded metal structure 23, as welded in position, and it will be appreciated that it is very difficult to apply a liquid film of the liquid coating material 12 on such irregular surface means 13. This difficulty is due to the projections and recesses defined by metal sheet 21 and expanded metal structure 23 resulting in surfaces which are to be coated being disposed in an infinite number of planes. Also, many of the surfaces to be coated are in hidden positions, as in spaces between portions of the expanded metal structure 23 and subjacent portions of the surface 22 of metal sheet 21 as shown at 25 in FIG. 6, for example.

After coating the irregular surface means 13 of workpiece 14 with liquid coating material 12 and utilizing the apparatus and method of this invention the workpiece is further processed, as desired, usually by applying another coating of a urethane base material (not shown) on the coating 16 followed by a rubber coating (also not shown) followed by bonding an ultra high molecular weight polymeric material 26 over the irregular surface means 13 utilizing any technique known in the art. One technique which may be used in bonding the polymeric material 26 in position is disclosed in the previously mentioned U.S. Pat. No. 4,238,039 and the entire disclosure of such application is incorporated herein by reference thereto. After molding of the ultra high molecular weight polymeric material 26 in position on the workpiece 14, the opposed side portions 27 and 28 of such workpiece are suitably formed therein to define the wear member 20 which is in the form of a coupler carrier wear member.

The means 11, of apparatus 10, for applying a liquid film of the liquid coating material 12 comprises means 30 for producing a standing wave of the liquid coating material 12 and such means comprises a reservoir 32 for containing a liquid material 12 and fluid nozzle means 33 submerged in the liquid material 12. The producing means 30 also comprises a pump 34 which has an inlet 35 in fluid communication with the liquid material 12 through the use of a conduit 36. The pump has an outlet 37 in flow communication with the nozzle means 33 through the use of a conduit 40. The pump 34 operates to pump the liquid material 12 through the nozzle means 33 to produce a standing wave of the liquid material 12 and such standing wave is designated generally by the reference numeral 41.

The standing wave 41 is provided in a stationary position and in particular at a fixed location 42 in the stationary reservoir 32. The wave 41 has a crest 43 disposed above the substantially planar main surface 44 of the liquid coating material 12; and, the crest 43 has a dimension which is at least as large as one dimension of the irregular surface means 13 of the workpiece 14.

The apparatus and method 10 also comprises means 45 for moving the workpiece 14 relative to the stationary standing wave 41 so that the liquid coating material 12 engages the irregular surface means 13 and defines a liquid film thereon. The moving means in this example of the invention is in the form of conveyor means shown as a belt conveyor 45 which is used to move each workpiece 14 so that irregular surface means 13 thereof is brought in engagement with the crest 43 of the standing wave thereby providing complete coating of substantially all portions of such irregular surface means 13 in an efficient manner.

The conveyor 45 of this example is in the form of a belt conveyor made of a nonmetallic material such as a reinforced polymeric material which may be reinforced rubber. The conveyor 45 includes means for detachably fastening a plurality of workpieces 14 to the conveyor and in this example of the invention, the means for detachably fastening the workpieces 14 to the conveyor comprises cooperating magnet means or sets 46 of permanent magnets 47. The magnets 47 of each set 46 are partially embedded in the rubber of the belt 45 which serves as a matrix therefor and the embedding may be achieved utilizing any suitable technique known in the art.

The belt conveyor is operated in an endless path, as is known in the art, and has a roller 50 at one end thereof and a roller 51 at its opposite end. The roller 50 is provided with a belt slack take-up mechanism 52 of known construction while the roller 51 is suitably operatively connected to a drive motor 53 for the conveyor 45 utilizing a mechanical drive connection 54.

The apparatus 10 also comprises a pair of cooperating guide channels of substantially U-shaped cross-sectional configuration and each channel is designated by the same reference numeral 56(FIG. 2). Each channel or guide 56 has a substantial U-shaped cross-sectional configuration and has diverging or outwardly flaring opposite ends 57 which assure smooth entry and exit of the lower flight of the conveyor 45. The guides 56 precisely control the vertical position of each workpiece 14 so the irregular surface means 13 thereof is engaged by the crest 43 of the standing wave 41 to provide a liquid film coating thereon in an efficient and precise manner. It will also be appreciated that suitable known means may be provided to adjust the vertical positions of the guide channels 56 to assure that only the irregular surface means 13 is coated by crest 43 with the liquid film 16 of coating material 12.

The apparatus and method 10 of this invention is particularly adapted to coat the irregular surface means 13 of each workpiece 14 in a continuous substantially semiautomatic manner. The conveyor 45 has a plurality of sets 46 of magnets 47 so that a corresponding plurality of workpieces 14 may be magnetically detachably fastened thereon and moved through the crest 45 of the standing wave 41 to provide a coating on their irregular surface means 13.

Each workpiece 14 may be positioned on the conveyor 45 utilizing any suitable technique known in the art including either automatic or manual means. In this example of the invention a plurality of workpiece 14 which are to be coated are carried on a pallet 60, as shown at 61 in FIG. 1, and each workpiece 14 is manually loaded against an associated set 46 of magnets 47. It will be appreciated that the conveyor 45 may also be provided with suitable means (not shown) in association with each set of magnets 46 to assure an associated workpiece 14 is loaded at the desired position, in the central portion of the belt conveyor 45, to assure proper engagement with the crest 45 of the standing wave 41.

Once the irregular surface means 13 of each workpiece 14 has been coated with a liquid film coating and dried in the heat tunnel 15, each completed workpiece may then be removed utilizing any suitable automatic or manual means. In this example of the invention each workpiece is manually removed from the magnets 47 holding same on the conveyor 45 and stacked as shown at 62 on a pallet 63 for further processing.

Figure 3:
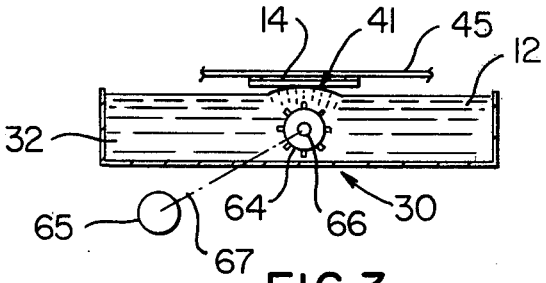
FIG. 3 is a view similar to the central portion of FIG. 1 illustrating a modification of the method and apparatus.

Reference is now made to FIG. 3 of the drawings which illustrates a modification of the apparatus and method of this invention wherein the means 30 for producing a standing wave comprises the reservoir 32 containing the liquid coating material 12 and paddle wheel means in the form of a paddle wheel 64. The paddle wheel 64 is submerged in the liquid 12 and the means 30 further comprises means for rotating the paddle wheel and such means is in the form of a drive motor 65 which is suitably mechanically connected to a central shaft 66 of the paddle wheel by a mechanical connection 67. The motor 65 rotates the paddle wheel 64 in a controlled manner to produce a standing wave 41 having a crest 43; and, the wave 41 of FIG. 3 is substantially identical to the standing wave 41 previously described. Each workpiece 14 is moved in position against the standing wave 41 of FIG. 3 so as to have its surface means 13 coated, utilizing the conveyor 45 of FIG. 1, and in a similar manner as previously described and such description will not be repeated.

Thus, it is seen that in accordance with the teachings of this invention a standing wave of nonmetallic coating material is produced and a workpiece having irregular surface means is moved relative to the standing wave so that the liquid coating material engages the irregular surface means and defines a liquid film thereon. The liquid film is suitably dried to solidify same and define the coating.

The nonmetallic liquid coating material 12 applied using the method and apparatus of this invention may be any suitable nonmetallic liquid material and in this disclosure wherein it is applied on the workpiece 14 which comprises metal support means for a railway vehicle wear member the liquid coating material is a primer sold by Hughson Chemicals, Lord Corporation, 2000 W. Grandview Blvd., Erie, PA 16512, under the trade designation ChemLok 205. After coating the irregular surface means 13 with this ChemLok 205 primer a coating of a material which is sold by this same organization under the trade designation ChemLok 238, is applied over the primer using the same method and apparatus 10 as described above. Following the application of this latter coat the workpiece 14 may be further processed as described earlier.

Although not specifically shown and described in this disclosure of the invention, the liquid 12 in the reservoir is provided with suitable controls and means for replenishing the liquid 12 to assure that the level of the main body of such liquid in the reservoir 32 is maintained within precise limits. In this manner the coating of irregular surface means 13 by the standing wave 41 is achieved with great precision.

The supports for the various components, power sources, controls, and the like have not been illustrated and described in this disclosure; however, it will be appreciated that these items will be provided as is known in the art.

While present exemplary embodiments of this invention, and methods of practicing the same, have been illustrated and described it will be recognized that this invention may be otherwise variously embodied and practiced within the scope of the following claims.

What is claimed is:

1. In a method for providing a coating on irregular surface means of a workpiece defined by metal support means for a railway vehicle, said support means comprising a metal sheet having a planar surface and a grid-like metal structure fixed against said planar surface, said irregular surface means being disposed in multiple planes and comprised of said grid-like structure and said planar surface; comprising the steps of providing a reservoir containing a substantially nonmetallic liquid coating material, applying a liquid film of said liquid coating material on all portions of said irregular surface means against said grid-like structure and said planar surface, and drying said liquid film to solidify same and define said coating, said applying step comprising the steps of producing a standing wave of said liquid coating material in a stationary position, forming a crest in said standing wave disposed above the substantially planar main surface of said material, said crest having a dimension which is at least as large as one dimension of said irregular surface means, and moving said work piece relative to said standing wave so that said liquid coating material engages said irregular surface means and defines said liquid film.

2. In a method for providing a coating on irregular surface means of metal support means for a railway vehicle wear member wherein said support means comprises a metal sheet having a planar surface and a grid-like metal structure fixed against said planar surface, said irregular surface means being comprised of said grid-like structure and said planar surface, said method comprising the steps of, providing a reservoir containing a substantially nonmetallic liquid coating material, applying a liquid film of said liquid coating material on all portions of said irregular surface means, and drying said liquid film to solidify same and define said coating, said applying step comprising the steps of, producing a standing wave of said liquid coating material in a stationary position, forming a crest in said standing wave disposed above the substantially planar main surface of said material, said crest having a dimension which is at least as large as one dimension of said irregular surface means, and moving said metal support means relative to said standing wave so that said liquid coating material engages said irregular surface means and defines said liquid film.

3. A method as set forth in claim 2 in which said producing step comprises pumping said liquid material through nozzle means to produce said standing wave.

4. A method as set forth in claim 2 in which said producing step comprises rotating paddle wheel means to produce said standing wave.

5. A method as set forth in claim 2 in which said moving step comprises the preparation step of detachably fastening said workpiece against movable conveyor means with said irregular surface means facing downwardly.

6. A method as set forth in claim 5 in which said detachably fastening step comprises detachably fastening said workpiece against a movable belt conveyor employing magnet means.

* * * * *